US007438604B2

(12) United States Patent
Andresen

(10) Patent No.: US 7,438,604 B2
(45) Date of Patent: Oct. 21, 2008

(54) DISTRIBUTOR BLOCK

(75) Inventor: Jens Andresen, Blomberg (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 11/934,182

(22) Filed: Nov. 2, 2007

(65) Prior Publication Data

US 2008/0176456 A1 Jul. 24, 2008

(30) Foreign Application Priority Data

Nov. 10, 2006 (DE) ..... 10 2006 053 352

(51) Int. Cl.
*H01R 9/22* (2006.01)

(52) U.S. Cl. ..... 439/709; 439/715; 439/721; 439/835

(58) Field of Classification Search ..... 439/709, 439/715, 716, 721, 835
See application file for complete search history.

(56) References Cited

U.S. PATENT DOCUMENTS 4,940,431 A * 7/1990 Hennemann ..... 439/715
5,071,356 A * 12/1991 Strate et al. ..... 439/721
5,588,881 A * 12/1996 Eggert et al. ..... 439/709
6,506,071 B2 * 1/2003 Lange ..... 439/715

* cited by examiner

*Primary Examiner*—Tho D Ta
(74) *Attorney, Agent, or Firm*—Bourque and Associates

(57) ABSTRACT

A distributor block exhibits multi-connectors at its front side in the manner of block terminals and at least one additional connector for each pole at its rear side, whereby a contact area is provided for each pole where terminal points are arranged in one common clamping plane. To reduce the number of current-conducting components and to provide clamping of the cables using a spring force, terminal points are formed through clamping supports that are at a distance from each other and that each interact with a contact tongue. To this end, each contact area houses a current-conducting board with the clamping supports being formed onto it, where two each of the contact tongues are components of a torsion spring with a bending joint that is followed by the contact tongue.

12 Claims, 5 Drawing Sheets

DISTRIBUTOR BLOCK

TECHNICAL FIELD

The invention relates to a wire connecting distributor block.

BACKGROUND INFORMATION

Distributor blocks are space-saving connection elements because, in addition to the connectors that are arranged in the front in a similar manner as with block terminals, they exhibit an additional connector on the rear side, which is, in particular, designed for plug-type connections, which can also be provided for feeding cables through walls of housings or cabinets. In its known design, numerous current-conducting elements with complicated configurations are required for the terminal points, which are located in one of the contact areas for each of the poles. Primarily, the known distributor blocks are equipped with screw terminals at their terminal points; in other designs, the terminal points are designed in insulation piercing technology.

SUMMARY

It is one objective of the invention to create a distributor block of the type mentioned above, where the number of components for conducting current is reduced in each of the contact areas, and furthermore these components are designed as simple stamping parts, and where they can be inserted into the respective contact areas in the distributor housing as pre-assembled units.

For the invention, it is essential that the terminal points are designed as spring terminals. In this regard, the current-conducting board is the carrying element for all current-conducting components in each of the contact areas of the distributor housing. Arranged on it are the clamping supports and the holders for the torsion springs, resulting in a structural unit that can be pre-assembled. This is because the torsion springs can be placed onto the holders such that they rest on the clamping supports through elastic contact of their contact tongues, and in this manner secured from falling off the current-conducting board when handling the pre-assembled unit.

Additional embodiment features of the invention become apparent from the dependent claims.

BRIEF DESCRIPTION OF DRAWINGS

Following, the invention is described in greater detail based on the drawings, of which.

DETAILED DESCRIPTION OF THE PREFERRED EMBODIMENTS

Figure 1:
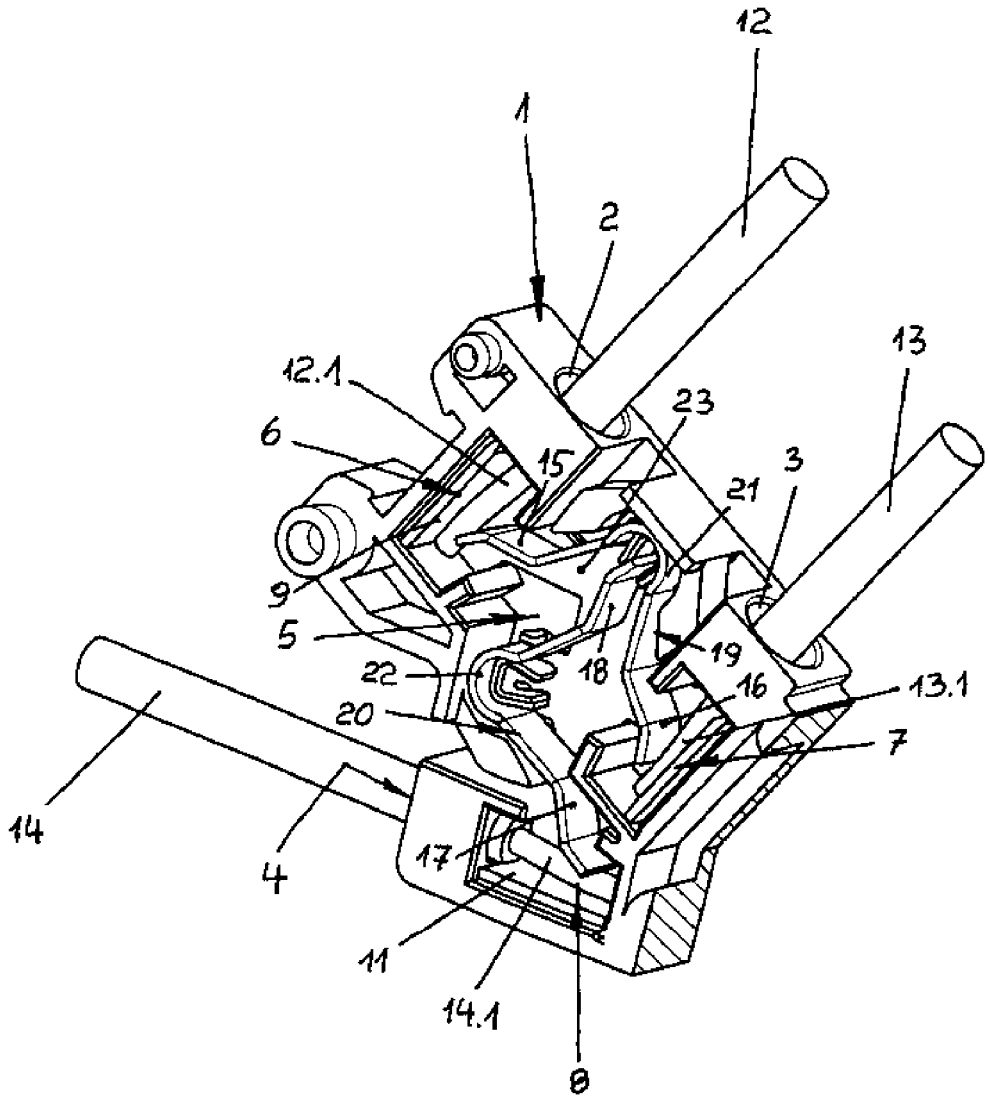
FIG. 1 is a perspective presentation of a housing section of a distributor block in the area of the contact area that is open to the side.

In detail, FIG. 1 shows the upper section of a distributor block housing 1 that exhibits at its front side two connectors 2 and 3, which are plug-type connectors. At its bottom side, the housing 1 is provided with an additional plug-type connector 4 of the same kind. Clamping of the conductors to be clamped via connectors 2-4 occurs by spring force. The connectors 2, 3, and 4 of the distributor block in multi-contact design shown in FIG. 1 are assigned to one single pole; accordingly, the associated current-conducting components on the inside of the housing 1 are electrically connected with one another.

Figure 2:
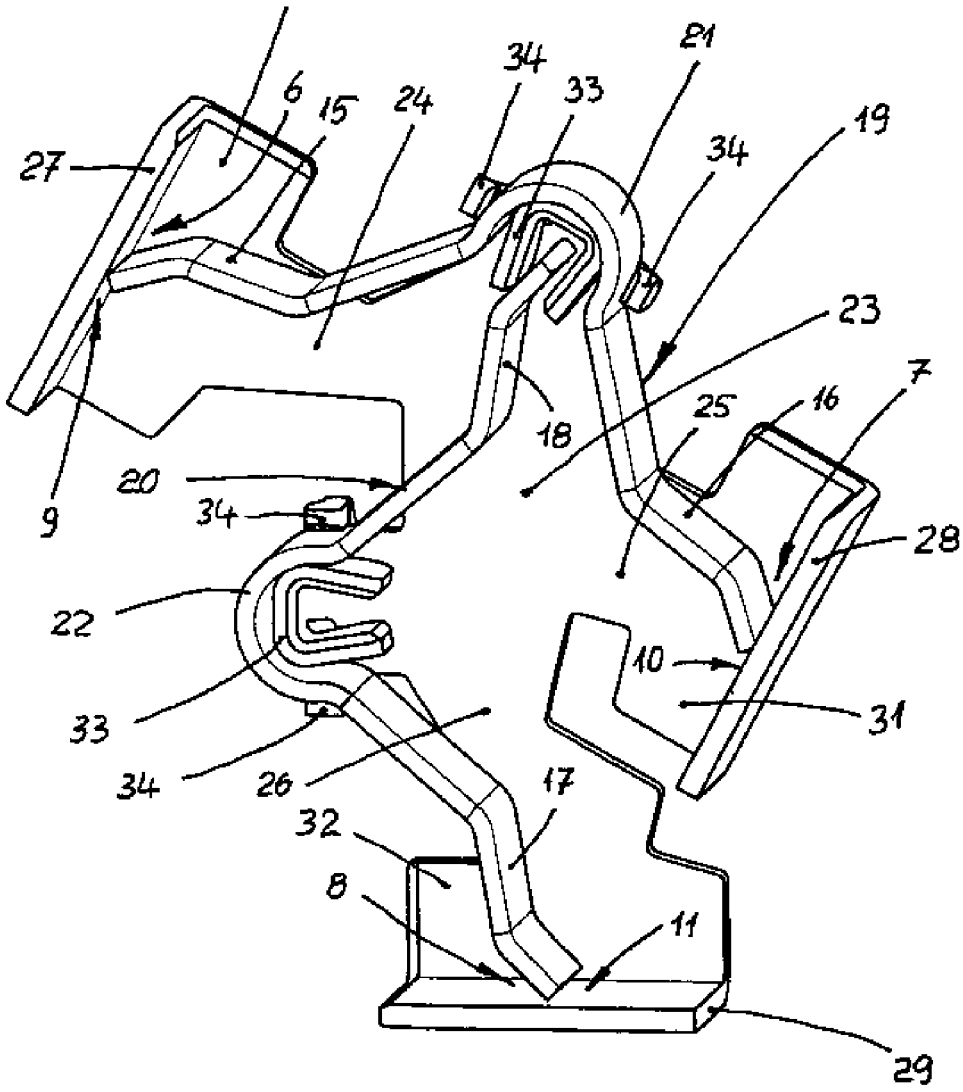
FIG. 2 is a perspective presentation of the current-conducting components including the terminal points that are located on them in the terminal area according to FIG. 1.

One contact area each with three terminal points 6-8 corresponding to the three connectors 2-4 is provided on the inside of the housing 1 for accommodating these components. As FIG. 2 shows complementary to that, the terminal points 6-8 each are formed by a clamping support 9-11 and a contact tongue 15-17, which rests against the clamping support 9-11 under spring load when no wire is clamped. FIG. 1 shows the clamped condition, where all three connectors 2-4 of this one pole of the distributor block are populated with cables 12-14, whose cores 12.1-14.1 contact the terminal points 6-8 by bracing them from the contact tongue 15-17 against the clamping supports.

The contact tongues 15-17 are components of two torsion springs 19 and 20 that are identical to one another. Because only three terminal points 6-8 are present, the second contact tongue 18 of the second torsion spring 20 is inactive, which does not carry weight in relation to the streamlining advantage of being able to use two identical torsion springs 19, 20. The two contact tongues 15, 16 and 17, 18 of the two torsion springs 19, 20 are each positioned at an obtuse angle towards each other and are connected to each other via a bending joint 21, 22. The torsion springs 19, 20 are leaf springs, which are formed from respective spring steel.

The central element in the contact area 5 is a current-conducting board 23, which is designed respectively in its center as a flat component, where parallel to its plane on the one side of the current-conducting board 23, terminal points 6-8 are located in a common plane. Arms 24-26 that exhibit right-angular end sections 30-32 are cut out of the current-conducting board 23. Along their centerline, the end sections 30-32 are angled at a right angle forming angles of bend 27-29, which form the clamping supports 9-11 with their sides that point toward the current-conducting board 23. The angles of bend 27 and 28, whose clamping supports 9 and 10 interact with the contact tongues 15 and 16 of the first torsion spring 19, are oriented parallel to each other. A symmetry plane extends between and parallel to these two angles of bend 27, 28 with the first torsion spring 19 being symmetrical to it. Accordingly, the torsion spring 19 has contact tongues 15, 16 that are of equal length and are formed mirror-symmetrical to each other; the same is the case for the contact tongues 17, 18 of the second torsion spring 20.

Holders 33, 34 are provided to secure the two torsion springs 19, 20 in their position. The holders 33, 34 for the first torsion spring 19 are located in the edge area of the current-conducting board 23, which is on the distant side of the arm 26 with the angle of bend 29. The holders 33, 34 consist of a receiving object 33 that supports the inside of the bending joint 21 of the torsion spring 19. The receiving object 33 protrudes from the current-conducting board 23 and has a C-shape, whose opening points to additional holders 33, 34 located at the opposite edge area of the current-conducting board 23 and on which the second leg spring 20 is held.

Additionally, the holders 33, 34 include outer restraints 34 that are used to secure the position of the torsion spring 19 through contact with the outer side of their bending joint 21. The holders 33, 34 for the second torsion spring 20 are designed in the same manner as those for the first torsion spring 19, which are held therein with their bending joint 22. The position of these additional holders 33, 34 corresponds to the orientation of the second torsion spring 20, whose inactive contact tongue 18 extends perpendicular to the first torsion spring 19, and that reaches with its free end into the interior of the receiving object 33 of the holders 33, 34 of the first torsion spring 19. The active contact tongue 17 of the second torsion spring 20 extends in the same, in sections almost parallel direction with the contact tongue 16 of the first torsion spring 19. The clamping support 11, or the angle of bend 29 that interacts with the contact tongue 17 of the second torsion spring 20 extends under that angle to the terminal point 7, 8 and the angles of bend 27, 28 for the interaction with the first torsion spring 19, which is defined by the different extension directions of the connectors 2 and 3 at the top side and 4 at the rear side of the distributor.

The current conducting board 23 and the two torsion springs 19 and 20 represent a pre-assembled unit, because using the holders 33, 34 and the clamping supports 9-11, the torsion springs 19, 20 that are mounted on the current-conducting board 23 are sufficiently secured in their operational position. In this manner, such a unit formed of the current-conducting board 23 and the torsion springs 19, 20 can be placed in the contact area 5.

Figure 3:
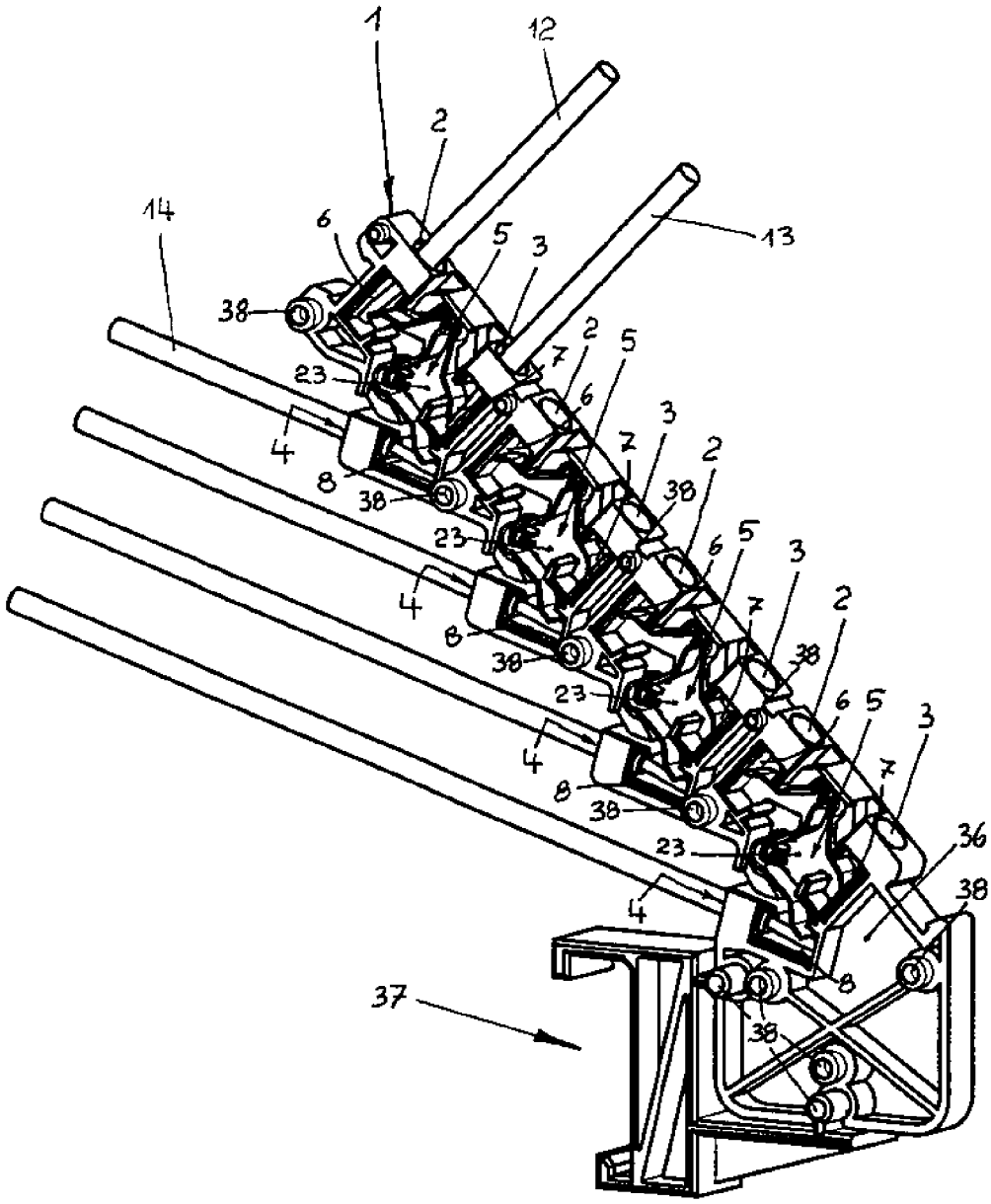
FIG. 3 is a perspective view of a complete, populated distributor housing with conductors connected to it.

FIG. 3 shows the housing 1 in its entirety. The contact areas 5 located in the housing 1 are consecutively aligned such that the terminal points 6-8 in all contact areas 5, and accordingly the connections 2-4, are located in one plane at the distributor housing 1.

Figure 4:
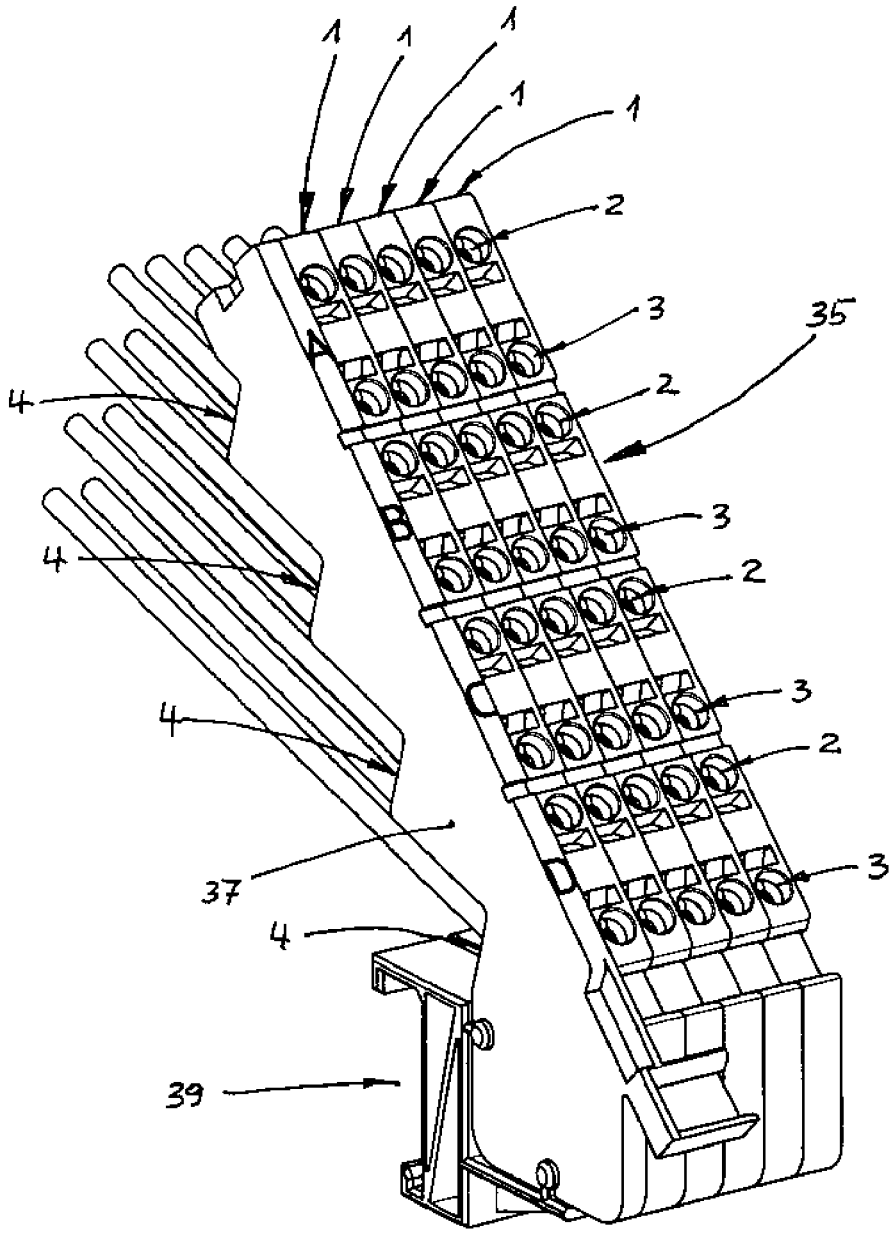
FIG. 4 is a perspective view of a block built of several housings according to FIG. 3.

Accordingly, the housing 1 exhibits a disk-shape. Perpendicular to the disk plane, two or more of the housings 1 can be connected in a congruent, adjacent arrangement in order to build a terminal block 35, as is shown in FIG. 4. As is also apparent from FIG. 3, the disk-shaped housings 1 have a closed sidewall 36 only at their one side. At the opposite side, the housings 1 are open and are closed when strung together by the sidewall 36 of the respective adjacent housing 1. Thus, a cover 37 is necessary only for the housing 1 located at the one end of the block 35 in order to close the open side of this housing 1. Engaging pegs or cams 38 are provided for connecting the housings to each other.

The housings 1 can be equipped with a mechanical clamping device 39 in order to snap them onto a mounting rail. In another embodiment, a plug-type device can be molded to the housing 1 in place of the clamping device 39, and together with the rear connectors can be formed as part of a plug-type connector, as can be used for feeding cables through walls of electrical cabinets.

Figure 5:
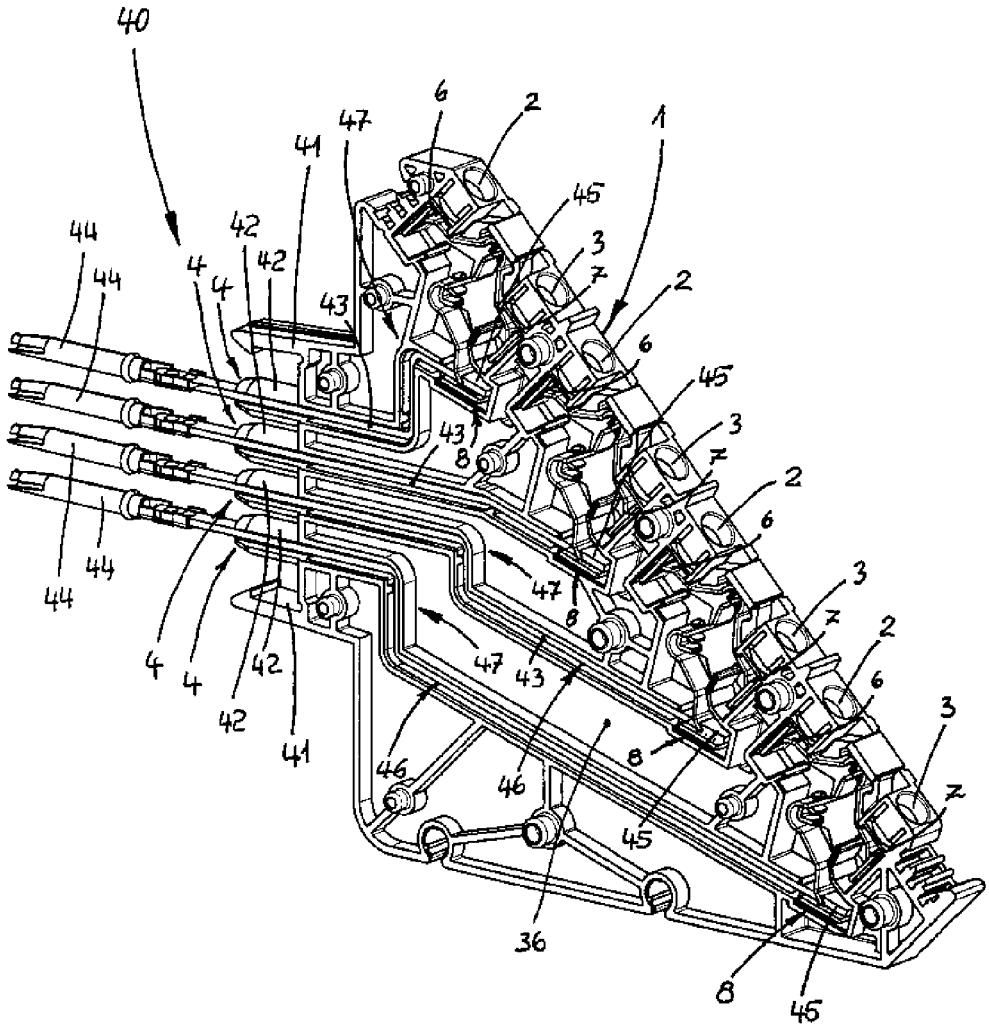
FIG. 5 is a perspective view of a complete, populated distributor housing of a different design.

Such an embodiment is shown in FIG. 5, where the rear area of the distributor housing 1, where the rear connectors 4 are located, are designed as multi-plug-type connectors 40. For the mechanical connection with a contact carrier of a contact insert, which is not shown in the drawing, fastening elements 41 and plug-type connecting links 42 are molded onto the rear side of the distributor housing 1. Conductor bars 43 that are led out of the distributor housing 1 are fed through the connecting links 42. Contact sockets 44, or in their place contact pins, are attached to the outer ends of the conductor bars 43 and are held in the mentioned, not shown contact carrier. The inner ends 45 of the conductor bars 43 are clamped at the terminal points 8 of the associated poles. Between the terminal points 8 and the connecting links 42 run conductor bars 43 in channels 46, which are molded onto the one sidewall of the opposite side of the housing 1 by being defined on both sides through protruding webs. In this manner, the channels 46 are open in the direction of the open side of the housing 1 and are closed in the same manner as the housing 1. The conductor bars 43 are secured from being pulled out of the housing 1 on the one hand through an angled run of the channels 46 with the respective angled sections 47, whereby the conductor bar is angled respectively. Furthermore, slip protectors can be provided at the cable systems at the terminal points, not only at the terminal points 8 but also at the terminal points 6 and 7. Several or many of such populated distributor housings 1, as are shown in FIG. 5, can be combined to a block in the same manner as is shown in FIG. 4.

The present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A distributor block with multiple connectors at its front side in the manner of block terminals and with at least one additional connector for each pole at its rear side, whereby a contact area is provided for each pole with terminal points being located in one common clamping plane, wherein the terminal points are formed by clamping supports that are at a distance from each other and interact with a contact tongue and further wherein a current-conducting board is arranged in each contact area parallel to the clamping plane, said current-conducting board having arms cut out of it from whose ends protrude angles of bend for forming the clamping supports at the same side of the current-conducting board, whereby each of the contact tongues are positioned at an obtuse angle to one another and are connected to one another via a bending joint, and are thereafter a component of a torsion spring, and in that at the edge areas of the current-conducting board at a distance from the angles of bend, holders are arranged on which the torsion springs are received in the area of the bending joint.

2. The distributor block as set forth in claim 1, wherein the two angles of bend at the current-conducting board run parallel to each other and are located opposite each other and interact with the same torsion spring which is held by holders that are located between these two angles of bend.

3. The distributor block as set forth in claim 2, wherein a third angle of bend at the current-conducting board is positioned at an angle to the two angles of bend that run parallel to each other and interacts with a second torsion spring that is equal to the first torsion spring and is held by two additional holders at the current-conducting board and whose second contact tongue is inactive.

4. The distributor block as set forth in claim 3, further including two torsion springs that are designed mirror-inverted to the angle bisector of the obtuse angle between their contact tongues.

5. The distributor block as set forth in claim 4, wherein the bending joint and the holders of a first torsion spring are located at the edge area of the current conducting board that is further away from the third angle of bend and wherein the inactive contact tongue of a second torsion spring extends into the area of the holders of the first torsion spring.

6. The distributor block as set forth in claim 1, wherein the holders of the torsion springs each consist of a C-shaped receiving object that protrudes from the current-conducting board, where the inside of the bending joint of the respective torsion spring is supported, and of restraints that protrude from the edge of the current-conducting board and support the outside of the bending joint of the torsion springs.

7. The distributor block as set forth in claim 6, characterized in that the inactive contact tongue of the second torsion spring is held with its free end in the C-shaped receiving object of the holders of the first torsion spring.

8. The distributor block as set forth in claim 2, wherein the two angles of bend that are parallel to each other and form the clamping supports of the first torsion spring are assigned to two connectors for one of the poles at the front side of the distributor and the third angle of bend that forms the clamping support of the second torsion spring is assigned to one connector for the same pole at the rear side of the distributor.

9. The distributor block as set forth in claim 1, wherein the contact areas in the distributor housing are aligned due to the fact that the terminal points at the current-conducting boards located in them are arranged in one common plane and in that accordingly, the distributor housing has a flat disk shape.

10. The distributor block as set forth in claim 9, wherein two or more of the disk-shaped distributor housings are combined congruently into one block perpendicular to the planes of their terminal points at the current conducting boards.

11. The distributor block as set forth in claim 9, wherein the rear connectors of the distributor housing are designed as multi-plug-type connectors, whereby fastener elements and plug-type connecting links are molded onto the rear of the distributor housing, and conductor bars are led through the connecting links out of the distributor housing and are clamped with their inside ends to the terminal point with the third clamping support of the respective pole.

12. The distributor block as set forth in claim 11, wherein open channels are molded in on the side between the plug-type connecting links and the terminal points and hold the connector bars, whereby these channels as well as the connector bars exhibit each at least one angled section.

* * * * *